United States Patent [19]

Martin

[11] Patent Number: 4,883,930

[45] Date of Patent: Nov. 28, 1989

[54] SWITCH MECHANISM OPERATING ROD

[75] Inventor: Donald R. Martin, Waukesha, Wis.

[73] Assignee: Cooper Power Systems, Inc., Houston, Tex.

[21] Appl. No.: 115,538

[22] Filed: Oct. 30, 1987

[51] Int. Cl.[4] ..... H01H 33/42

[52] U.S. Cl. ..... 200/148 F; 200/148 R; 174/178; 174/182; 174/186

[58] Field of Search ..... 174/177, 178, 179, 180, 174/186; 200/148 F

[56] References Cited

U.S. PATENT DOCUMENTS

| | | | |
|---|---|---|---|
| 1,501,688 | 7/1924 | Steinberger | 174/186 |
| 2,888,257 | 5/1959 | Taylor | 267/1 |
| 3,189,717 | 6/1965 | Tominaga | 200/148 |
| 3,877,523 | 4/1975 | Ely | 403/202 |
| 4,360,288 | 11/1982 | Rutledge, Jr. et al. | 403/268 |
| 4,663,498 | 5/1987 | Rye | 174/186 |

*Primary Examiner*—Robert S. Macon

*Attorney, Agent, or Firm*—Nelson A. Blish; Eddie E. Scott; Alan R. Thiele

[57] ABSTRACT

A switch apparatus comprising a switch mechanism including a first contact, and a second contact movable into and out of engagement with the first contact for respectively closing and opening the switch mechanism, an operating rod assembly connected to the second contact for moving the second contact into and out of engagement with the first contact in response to movement of the operating rod assembly, the operating rod assembly including an operating rod having an outer surface, a first end adapted to be connected to a prime mover, and an opposite second end, and a conductive member connected to the second end of the operating rod and to the second contact, the conductive member having a construction for reducing the magnitude of electrical stress adjacent the outer surface and for positioning electrical stress away from the outer surface, and a pressure vessel for enclosing the switch mechanism and the operating rod assembly and surrounding the switch mechanism and the assembly with dielectric gas.

7 Claims, 1 Drawing Sheet

10
12
14
16
18
22
24
26
28
29
30
32
34
36
38
40
42
44
46
48
50
52
54
56
58
60
62
70
72

SWITCH MECHANISM OPERATING ROD

BACKGROUND OF THE INVENTION

The invention relates to switch and interrupter mechanisms, and more particularly to operating rods for moving the movable contact of such mechanisms.

A known switch or interrupter mechanism includes a first contact that is axially movable toward and away from a fixed contact. The mechanism is enclosed within a vessel containing a dielectric fluid, such as $SF_6$ gas, which has a low dielectric constant. A prime mover provides the energy for moving the first contact and is connected thereto by an operating rod. Typically, the operating rod includes an insulating portion having a high dielectric constant and having thereon a conductive portion or end fitting that is pivotally connected to the first contact by a pin.

The point at which the conductive fitting, the high-dielectric-constant insulating portion and the low-dielectric-constant gas meet is known as a triple point. The triple point is subject to high electrical stress. In the past, stress relief has been provided by placing a grading shield over the triple point.

SUMMARY OF THE INVENTION

The invention provides a switch operating rod assembly including an insulating rod and a conductive end fitting mounted on the end of the rod and adapted to be connected to the movable contact of a switch or interrupter mechanism. The end fitting is shaped to reduce electrical stress and to locate the stress away from the outer surface of the rod.

More particularly, the rod is generally cylindrical and has an end and an outer surface, and the end fitting includes a first portion fixedly connected to and contacting the end of the rod. Still more particularly, the first portion of the end fitting has therein a cylindrical recess receiving the end of the rod. The end fitting also includes a second portion which is annular, which extends from the first portion in the direction away from the end of the rod, which surrounds the rod, and which is radially spaced from the outer surface of the rod. Thus, the second portion of the end fitting and the outer surface of the rod define an annular gap. Since the switch mechanism is enclosed by $SF_6$ gas, this gap is filled with the gas, and the triple point is located at the inner end of the gap. Preferably, the gap has an axial length of 0.25 inches.

In the preferred embodiment, the second portion of the end fitting has a cylindrical inner surface facing the outer surface of the rod, a cylindrical outer surface facing away from the outer surface of the rod, and an end surface extending from the inner surface to the outer surface. The end surface is curved and includes an inner portion adjacent the inner surface and having a first radius of curvature, and an outer portion adjacent the outer surface and having a second radius of curvature which is approximately twice the first radius of curvature. Preferably, the second portion of the end fitting has a thickness (the distance between the inner surface and the outer surface) of 0.1875 inches, the first radius of curvature is equal to 0.109 inches, and the second radius of curvature is equal to 0.203 inches. These different radii, as compared to equal radii, reduce the magnitude of the electrical stress near the rod surface and position the stress away from the rod surface.

Other features and advantageous of the invention will become apparent to those skilled in the art upon review of the following detailed description, claims and drawings.

Figures 1, 2, 3:
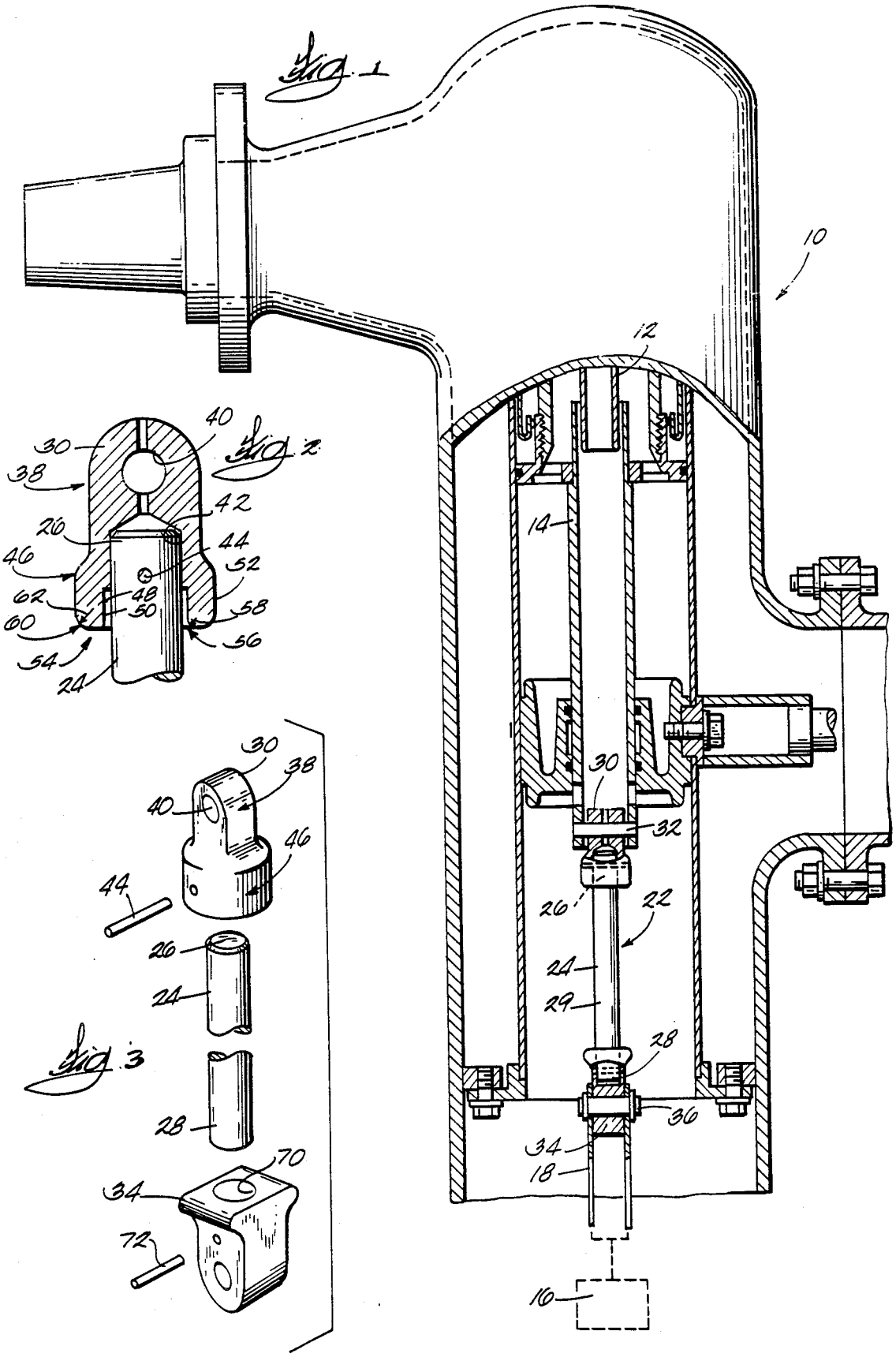
FIG. 1 is an elevational view, partially in section, of a switch apparatus embodying the invention and comprising an operating rod assembly including an end fitting.
FIG. 2 is an enlarged cross-sectional view of the end fitting.
FIG. 3 is an exploded view of the assembly.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting rod surface. This increases the dielectric withstand capability of the operating rod.

DETAILED DESCRIPTION OF THE DRAWINGS

A switch mechanism 10 embodying the invention is illustrated in the drawings. As shown in FIG. 1, the switch mechanism 10 comprises a tubular fixed contact 12 and a tubular movable contact 14 which is movable into and out of engagement with the fixed contact 12 for respectively closing and opening the switch mechanism 10. For more details on the switch mechanism, see copending U.S. application Ser. No. 115,529, titled "Suicide Switch/Interrupter with Variable Volume Chamber and Puffer Action," which is assigned to the assignee of the present application and which is incorporated herein by reference. It should be understood that other switch mechanisms can be employed.

The mechanism 10 also comprises a suitable prime mover 16 (shown schematically) for moving the contact 14. The prime mover 16 includes a bell crank 18.

The mechanism 10 also comprises an operating rod assembly 22 connected between the bell crank 18 and the contact 14 for moving the contact 14 in response to movement of the bell crank 18. In the preferred embodiment, the operating rod assembly 22 includes a cylindrical, insulating rod 24 having a diameter, opposite first and second or upper and lower ends 26 and 28, respectively, and an outer surface 29. The assembly 22 also includes a first, conductive end fitting 30 mounted on the first end 26 of the rod 24 and pivotally connected to the contact 14 by a pin 32, and a second, conductive end fitting 34 mounted on the second end 28 of the rod 24 and pivotally connected to the bell crank 18 by a pin 36.

As shown in FIG. 2, the end fitting 30 includes a first portion 38 having therethrough an aperture 40 that pivotally houses the pin 32. The first portion 38 also has therein a blind, cylindrical bore 42 that receives the end 26 of the rod 24. The end fitting 30 and the rod 24 are be secured together by suitable means such as a pin 44.

The end fitting 30 also includes means for reducing the magnitude of electrical stress adjacent the outer surface 29 of the rod 24 and for positioning electrical stress away from the outer surface 24. While various suitable means can be employed, in the preferred embodiment, such means includes, on the end fitting 30, a second portion 46 which is integrally connected to the first portion 38, which extends from the first portion 38 and extends axially of the rod 24 in the direction away from the end 26 of the rod 24, which is annular, which surrounds the rod 24, and which is radially spaced from the outer surface 29 of the rod 24 to define an annular gap 48 between the rod 24 and the second portion 46 of the end fitting 30. Preferably, the gap 48 has a length of 0.25 inches.

More particularly, the second portion 46 includes a cylindrical inner surface 50 facing and coaxial with the outer surface 29 of the rod 24, and an outer surface 52 facing away from and coaxial with the outer surface 29 of the rod 24. The inner surface 50 and the rod outer surface 29 define the gap 48. Preferably, the second portion 46 has a thickness (i.e., the radial distance between the inner surface 50 and the outer surface 52) of approximately 0.1875 inches. The second portion 46 also includes a curved, annular end surface 54 extending between the inner surface 50 and the outer surface 52 and generally facing away from the end 26 of the rod 24. The end surface 54 includes an inner portion 56 located adjacent the inner surface 50 and having a first radius of curvature 58, and an outer portion 60 located adjacent the outer surface 52 and having a second radius of curvature 62 which is greater than the first radius of curvature 58. In the preferred embodiment, the second radius of curvature 62 is approximately two times the first radius of curvature 58. More particularly, the first radius of curvature 58 is approximately 0.109 inches, and the second radius of curvature 62 is approximately 0.203 inches.

Since the operating rod assembly 22 is surrounded by dielectric gas, the gap 48 is filled with gas, and the triple point (at which the gas, the end fitting 30 and the rod 24 meet) is located at the inner end of the gap 48 where the end fitting 30 meets the rod 24. The different radii of the end surface portions 56 and 60, as compared to equal radii, reduce the magnitude of the electrical stress near the rod surface 29 and position the stress away from the rod surface 29. This increases the dielectric withstand capability of the operating rod 24.

The end fitting 34 has therein a blind, cylindrical bore 70 that receives the end 28 of the rod 24. The end fitting 34 and the rod 24 are secured together by suitable means such as a pin 72.

Various features of the invention are set forth in the following claims.

I claim:

1. A switch apparatus comprising a switch mechanism including a first contact, and a second contact movable into and out of engagement with said first contact for respectively closing and opening said switch mechanism, an operating rod assembly connected to said second contact for moving said second contact into and out of engagement with said first contact in response to movement of said operating rod assembly, said operating rod assembly including an operating rod having an outer surface, a first end adapted to be connected to a prime mover, and an opposite second end, and a conductive member connected to said second end of said operating rod and to said second contact, said conductive member including a first portion contacting and connected to said second end of said rod, and a second portion connected to said first portion, said second portion extending, from said first portion, in the direction away from said second end of said rod, said second portion telescopingly overlapping said rod, and said second portion including a radially inner surface facing said outer surface of said rod, a radially outer surface facing away from said outer surface of said rod, and an end surface generally facing away from said second end of said rod and extending between said inner surface and said outer surface, said end surface including an inner portion located adjacent said inner surface and having a first radius of curvature, and an outer portion located adjacent said outer surface and having a second radius of curvature which is greater than said first radius of curvature, and means for enclosing said switch mechanism and said operating rod assembly and surrounding said switch mechanism and said assembly with dielectric gas.

2. An apparatus as set forth in claim 1 wherein said second portion is radially spaced from said outer surface of said rod, whereby said second portion and said outer surface of said rod define therebetween an annular space.

3. An apparatus as set forth in claim 1 wherein said second radius of curvature is approximately two times said first radius of curvature.

4. A switch apparatus comprising a switch mechanism including a first contact, and a second contact movable into and out of engagement with said first contact for respectively closing and opening said switch mechanism, an operating rod assembly connected to said second contact for moving said second contact into and out of engagement with said first contact in response to movement of said operating rod assembly, said operating rod assembly including an operating rod having an outer surface, a first end adapted to be connected to a prime mover, and an opposite second end, and a conductive member connected to said second contact, said conductive member including a first portion contacting and connected to said second end of said rod, and a second portion connected to said first portion, said second portion extending, from said first portion, in the direction away from said second end of said rod, said second portion telescopingly overlapping said rod and being radially spaced from said outer surface of said rod, whereby said second portion and said outer surface of said rod define therebetween an annular space, and said second portion including a radially inner surface facing said outer surface of said rod, a radially outer surface facing away from said outer surface of said rod, and an end surface generally facing away from said second end of said rod and extending between said inner surface and said outer surface, said end surface including an inner portion located adjacent said inner surface and having a first radius of curvature, and an outer portion located adjacent said outer surface and having a second radius of curvature which is approximately two times said first radius of curvature, and means for enclosing said switch mechanism and said operating rod assembly and surrounding said switch mechanism and said assembly with dielectric gas.

5. An operating rod assembly adapted to be connected to the movable contact of a switch mechanism for moving the movable contact into and out of engagement with a fixed contact in response to movement of said operating rod assembly, said operating rod assembly comprising an operating rod having an outer surface, a first end adapted to be connected to a prime mover, and an opposite second end, and a conductive member connected to said second end of said operating rod and adapted to be connected to the movable contact, said conductive member including a first portion contacting and connected to said second end of said rod, and a second portion connected to said first portion, said second portion extending, from said first portion, in the direction away from said second end of said rod, said second portion telescopingly overlapping said rod, and said second portion including a radially inner surface facing said outer surface of said rod, a radially outer surface facing away from said outer surface of said rod, and an end surface generally facing away from said second end of said rod and extending between said inner surface and said outer surface, said end surface including an inner portion located adjacent said inner surface and having a first radius of curvature, and an outer portion located adjacent said outer surface and having a second radius of curvature which is greater than said first radius of curvature.

6. An assembly as set forth in claim 5 wherein said second portion is radially spaced from said outer surface of said rod, whereby said second portion and said outer surface of said rod define therebetween an annular space.

7. An assembly as set forth in claim 5 wherein said second radius of curvature is approximately two times said first radius of curvature.

* * * * *